US009421675B2

(12) United States Patent
Yu

(10) Patent No.: US 9,421,675 B2
(45) Date of Patent: Aug. 23, 2016

(54) ADJUSTABLE TORQUE SCREWDRIVER

(75) Inventor: Wentian Yu, Hangzhou (CN)

(73) Assignees: Hangzhou Great Star Tools Co., Ltd., Hangzhou (CN); Hangzhou Great Star Industrial Co., Ltd., Hangzhou (CN)

( * ) Notice: Subject to any disclaimer, the term of this patent is extended or adjusted under 35 U.S.C. 154(b) by 0 days.

(21) Appl. No.: 13/634,162

(22) PCT Filed: Sep. 4, 2012

(86) PCT No.: PCT/CN2012/080945
§ 371 (c)(1),
(2), (4) Date: Jun. 5, 2013

(87) PCT Pub. No.: WO2013/143258
PCT Pub. Date: Oct. 3, 2013

(65) Prior Publication Data

US 2015/0090078 A1 Apr. 2, 2015

(30) Foreign Application Priority Data

Mar. 26, 2012 (CN) ..... 2012 1 0082515

(51) Int. Cl.
*B25B 23/142* (2006.01)
*B25B 23/14* (2006.01)
*B25B 15/04* (2006.01)

(52) U.S. Cl.
CPC ..... *B25B 23/1427* (2013.01); *B25B 15/04* (2013.01); *B25B 23/141* (2013.01)

(58) Field of Classification Search
CPC .. B25B 23/1427; B25B 23/141; B25B 15/02; B25B 23/14; B25B 21/00
See application file for complete search history.

(56) References Cited

U.S. PATENT DOCUMENTS 2,396,040 A * 3/1946 Darling ..... 74/126
4,653,359 A * 3/1987 Liao ..... B25B 23/147 173/93

(Continued)

FOREIGN PATENT DOCUMENTS

CN 201082530 Y 7/2008
CN 201931412 U 8/2011

(Continued)

OTHER PUBLICATIONS

Search report issued Sep. 6, 2015, in co-pending Chinese Application Serial No. 2012100825151.

*Primary Examiner* — Robert Scruggs
(74) *Attorney, Agent, or Firm* — Dinsmore & Shohl LLP; Douglas L. Wathen

(57) ABSTRACT

The invention provides an adjustable torque screwdriver, including a torque input assembly and a torque output assembly, and further including a ratchet pair, which comprises a first ratchet and a second ratchet, respectively having circular teeth. The torque input assembly transmits the torque to the first ratchet, and the second ratchet then transmits the torque to the torque output assembly, and the circular teeth are arranged to enable the ratchet pair to slip either clockwise or counterclockwise, but not to slip in the respective opposite direction. The adjustable torque screwdriver also includes an adjusting assembly and an elastic assembly, the elastic assembly exerting pressure to the ratchet to tightly fit the ratchet pair, the adjusting assembly loading and unloading the elastic assembly, thereby adjusting the exerted pressure and the in-between fitting tightness of the ratchet pair, thus adjusting the torque for the ratchet pair to slip.

15 Claims, 4 Drawing Sheets

(56) References Cited

U.S. PATENT DOCUMENTS

| | | | | |
|---|---|---|---|---|
| 7,455,123 | B2 * | 11/2008 | Aeberhard | B25B 23/141 173/176 |
| 7,647,852 | B1 * | 1/2010 | Rinner | B25B 13/463 192/43.1 |
| 7,793,572 | B2 * | 9/2010 | Hirt | B25B 23/141 279/103 |
| 2009/0044668 | A1 | 2/2009 | Lin et al. | |
| 2010/0274230 | A1 * | 10/2010 | Edgell | A61N 1/3752 606/1 |

FOREIGN PATENT DOCUMENTS

| | | | |
|---|---|---|---|
| CN | 202517414 | U | 11/2012 |
| DE | 202010008300 | U1 | 11/2010 |
| DE | 202011051298 | U1 | 12/2011 |

* cited by examiner

ADJUSTABLE TORQUE SCREWDRIVER

CROSS REFERENCE TO RELATED APPLICATIONS

This utility patent application is a U.S. National Phase of PCT/2012/080945, filed Sep. 4, 2012, which claims priority from CN 201210082515.1, filed Mar. 26, 2012, the entire contents of which are incorporated herein by reference.

FIELD OF THE INVENTION

This invention relates to an adjustable torque screwdriver, and pertains to the field of manual tools.

BACKGROUND OF THE INVENTION

Generally, the output torque of an ordinary screwdriver is not adjustable, relying merely on the user's experience to control the torque applied. So when the torque needs to be controlled precisely, as in the case of interconnections between various parts of precise instruments, or in the case of brittle or easily damaged fastening and/or fastened parts, excessive force or too large an exerted torque may damage the parts. In such a case, experience of the operator is the sole reliance, and therefore there is a certain prerequisite for the user, for example, he/she needs to be a skilled mechanic.

SUMMARY OF THE INVENTION

In light of the foregoing limitations of an ordinary screwdriver, the present invention provides an adjustable torque screwdriver of which the size of output torque can be adjusted according to the needs of users, thus allowing multi-stage adjustment of the output torque. When the torque exerted by the user is larger than the set torque, the torque output shaft of the screwdriver slips, thereby shutting off the output of torque.

In light of the defects of the prior art, the invention aims to solve the technical problem by providing an adjustable torque screwdriver.

To this end, the invention provides an adjustable torque screwdriver, including a torque input assembly and a torque output assembly, and further including a ratchet pair, which comprises a first ratchet and a second ratchet, respectively having circular teeth. The torque input assembly transmits the torque to the first ratchet, and the second ratchet then transmits the torque to the torque output assembly, and the circular teeth are arranged to enable the ratchet pair to slip either clockwise or counterclockwise, but not to slip in the respective opposite direction. The adjustable torque screwdriver also includes an adjusting assembly and an elastic assembly, the elastic assembly exerting pressure to the ratchet to tightly fit the ratchet pair, the adjusting assembly loading and unloading the elastic assembly, thereby adjusting the exerted pressure and the in-between fitting tightness of the ratchet pair, thus adjusting the torque for the ratchet pair to slip.

In a preferred embodiment of the invention, the elastic assembly is a spring group which includes a plurality of springs approximately concentrically disposed, each of the springs having respectively a specific free height and an elastic modulus.

In a further preferred embodiment of the present invention, the spring group includes a first spring and a second spring; the free height of the first spring is larger than that of the second spring, and the elastic modulus of the second spring is larger than that of the first spring.

In another preferred embodiment of the invention, the adjusting assembly is an outer casing with an internal thread and an interior ring with an external thread. The interior ring matches with the outer casing through the threads, and not allowed to rotate about the axis of the screwdriver; when the outer casing revolves about the axis of the screwdriver relative to the interior ring, the interior ring translates relative to the elastic assembly under the effect of the thread pair, thus loading or unloading the elastic assembly.

In another preferred embodiment of the invention, the embodiment also includes a flange rotating together with the outer casing, a plurality of round holes arranged on the flange, and a bead mating with the round holes and the grading spring biasing the bead.

In another preferred embodiment of the invention, the outer casing is disposed in the head part of the adjustable torque screwdriver, and the ratchet pair and the elastic assembly are disposed in the outer casing.

In another preferred embodiment of the invention, the elastic assembly is disposed on the side of the first ratchet.

In another preferred embodiment of the invention, the outer casing is rotatably connected to the handle about the axis of the adjustable torque screwdriver.

In another preferred embodiment of the invention, the handle has a cavity, to be used for storing screwdriver blades mountable on the screwdriver.

In another preferred embodiment of the invention, the handle has a rear cover.

In another preferred embodiment of the invention, grading marks are arranged on the outer casing, and an indication arrow is arranged on the handle.

The adjustable torque screwdriver according to the invention can set maximum output torque thereof in a set direction in order to produce a more accurate output torque; when the torque exceeds the set grade, the output shaft automatically slips so as to avoid damage to the fastening/fastened pieces and the bit of the screwdriver, not relying on the operating skill of the user, thus there is no specific requirement for the user.

Further, the invention adopts a spring group composed of multi-stage springs to adjust the maximum output torque of the screwdriver, achieving a wider range of output torque, a more precise setting in particular in the low range of torque, and a longer service life than that of a single spring.

In addition, as the ratchet pair and the elastic assembly are disposed in the outer casing of the head part of the screwdriver, the center of gravity of the screwdriver is closer to the output shaft of the screwdriver, and therefore the screwdriver works more stably, and the vibrations of the bit of the screwdriver is weaker when slipping occurs.

BRIEF DESCRIPTION OF THE DRAWINGS

Referencing now to the figures, the conception, detailed structure and induced technical effect of the present invention will be expounded for due understanding of the purpose, characterizations and effects of the present invention.

DETAILED DESCRIPTION OF THE PREFERRED EMBODIMENTS

Figure 1:
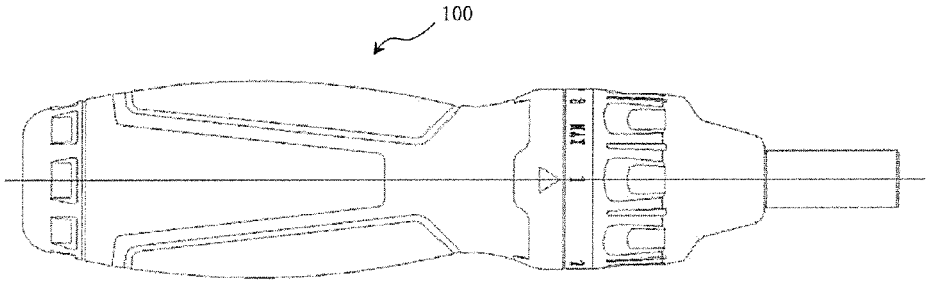
FIG. 1 is a front view of an adjustable torque screwdriver of a preferred embodiment of the present invention.

FIG. 1 shows a preferred embodiment of an adjustable torque screwdriver 100 according to the invention, the screwdriver 100 having a torque input assembly, a torque output assembly and a torque control assembly. And it is one main object of the present invention to output the torque by the torque output assembly, which is exerted by the user from the torque input assembly and transmitted through the torque control assembly, so as to realize the maximum output torque control of the screwdriver 100 in a single direction (usually the clockwise direction for tightening the screw).

Figure 2:
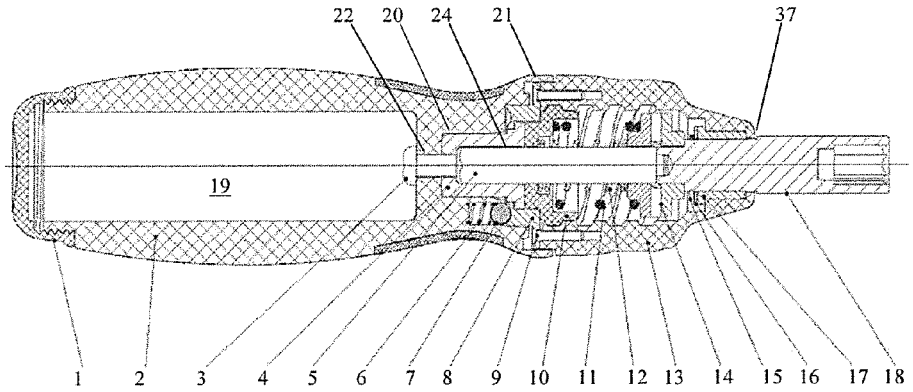
FIG. 2 is a cross-sectional view of an adjustable torque screwdriver of a preferred embodiment of the present invention.
Figure 3:
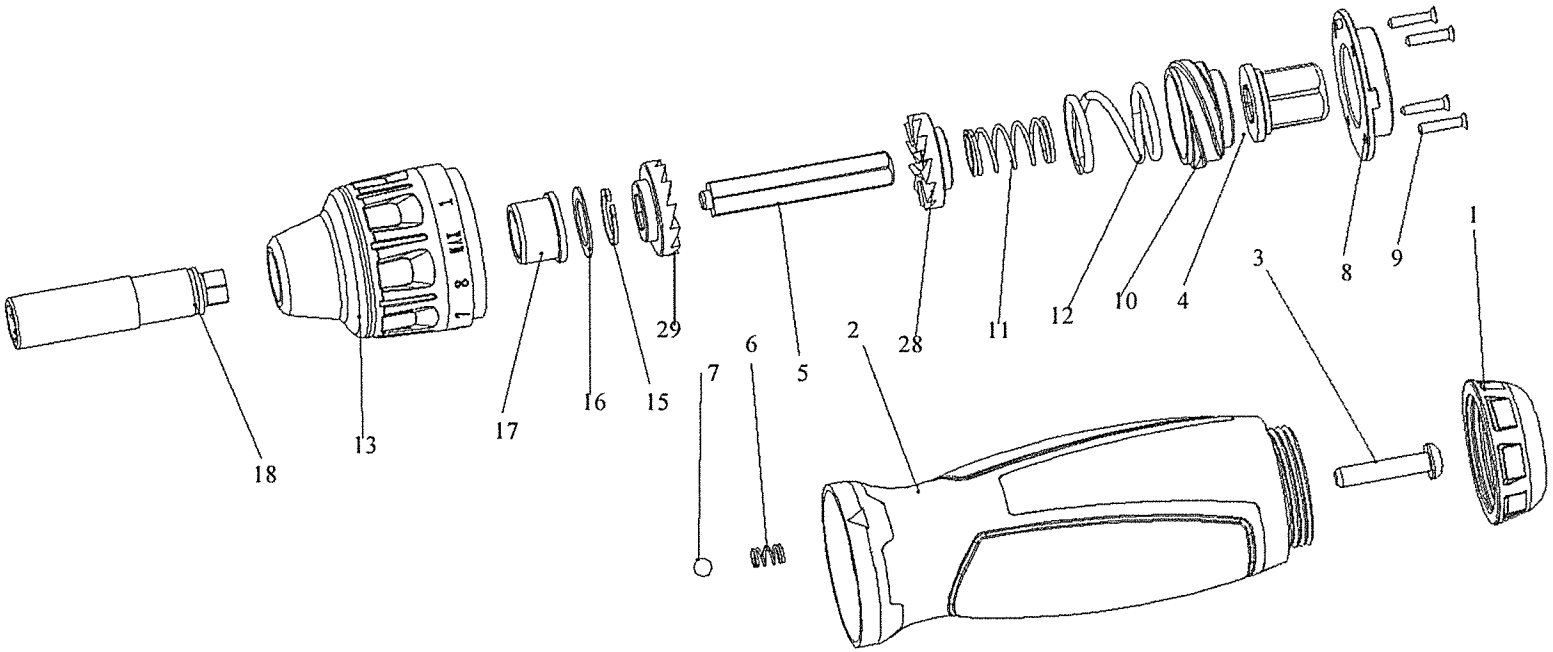
FIG. 3 is an exploded perspective view of an adjustable torque screwdriver of a preferred embodiment of the present invention.
Figure 4:
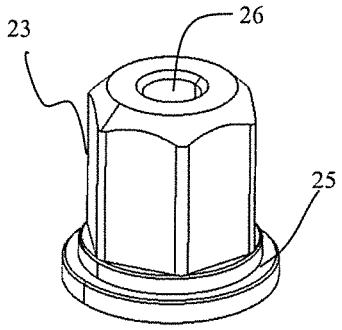
FIG. 4 is a perspective view of a hexagonal sleeve of an adjustable torque screwdriver of a preferred embodiment of the present invention.
Figure 5:
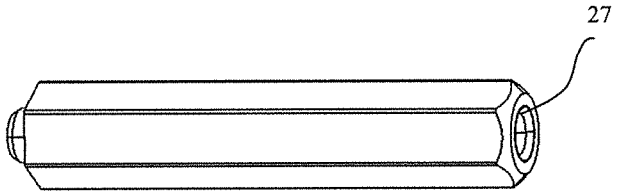
FIG. 5 is a perspective view of a hexagonal drive rod of an adjustable torque screwdriver of a preferred embodiment of the present invention.

As shown in FIG. 1-3, the torque input assembly includes a handle 2 which is arranged with a cavity 19 therein, and one end of which is arranged with a rear cover 1. The first hexagonal hole 20 and the axially extended periphery 21 are disposed at the other end of the handle 2, where a first connection hole 22 is arranged at the bottom of the first hexagonal hole 20, being in communication with cavity 19. The torque input assembly also includes a hexagonal sleeve 4 as shown in FIG. 4. As shown in the figure, the structure of the hexagonal sleeve 4 includes an outer hexagonal column 23, a second hexagonal hole 24 and a convex edge 25, and a second connection hole 26 is arranged at the bottom of the hexagonal hole 24. As shown in FIG. 5, the torque input assembly also includes a hexagonal drive rod 5 having an hexagonal contour, and a third connection hole 27 with an internal thread is arranged at an end thereof. During assembly, the hexagonal column 23 of hexagonal sleeve 4 is inserted into and fits the first hexagonal hole 20 of handle 2, and the end of hexagonal drive rod 5 arranged with a third connection hole 27 is inserted into and fits the second hexagonal hole 24 of the hexagonal sleeve 4, where the first, second and third connection holes 22, 26 and 27 are axially aligned and of the same diameter, and through the cavity 19 of handle 2, screw 3 is screwed into the first, second and third connection holes 22, 26 and 27 to draw the axial engagement of handle 2, hexagonal sleeve 4 and hexagonal drive rod 5. In addition, through the connections between handle 2 and hexagonal sleeve 4, and between hexagonal sleeve 4 and hexagonal drive rod 5 via the fitness of a column with an angular periphery and a polygonal hole, the torque exerted on handle 2 is transmitted to hexagonal sleeve 4 and hexagonal drive rod 5, and then is transmitted to the torque control assembly in this embodiment.

The aforementioned is only a specific description of a torque transmission method, the object of which is to realize torque input in the adjustable torque screwdriver 100 of the invention. It should be understood by the technicians in the field that, other torque transmission means in the prior art are also adaptable to, but are not intended to be restricted by, the present invention.

Figure 6:
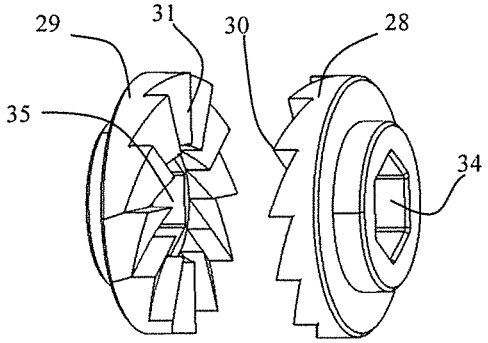
FIG. 6 is a perspective view of a ratchet pair of an adjustable torque screwdriver of a preferred embodiment of the present invention.

Now further description of the torque control assembly of the embodiment of the invention will be expounded, as shown in FIG. 2. The torque control assembly includes a ratchet pair 14, as seen in FIG. 3 and FIG. 6, which includes a first ratchet 28 and a second ratchet 29, and the first ratchet 28 and the second ratchet 29 have, on their opposing end surfaces, respectively circular teeth 30, 31, matching with each other. Thus the first ratchet 28 and the second ratchet 29 overcome a certain axial force under the effect of the input torque and slip in the pre-set direction of clockwise or counterclockwise, but are not allowed to slip in the opposite direction. And the axial force determines the difficulty of slip or the required input torque causing slip. Thus, the limit of the input torque causing slip can be controlled by controlling the axial force between ratchet 28 and ratchet 29; when the input torque in the set direction exceeds this limit, slip occurs between ratchets 28 and 29, thereby cutting off the rotation and torque output. Generally, this embodiment included, ratchets 28, 29 is set to slip in the clockwise direction for screw tightening. In addition, hexagonal through holes 34 and 35 are arranged axially in ratchets 28 and 29, and hexagonal drive rod 5 is inserted into the first hexagonal through hole 34 so as to transmit the torque to ratchet 28.

The axial force between the ratchets 28 and 29 is usually provided by the elastic assembly, engaging one of the ratchets 28, 29, on the opposite side to the side of the teeth. The larger the pressure imposed on ratchet pair 14 is, the greater the fitting tightness between the ratchet pair. The elastic assembly may be a single spring or a spring group configured in accordance to their different free height and elastic modulus, as shown in FIG. 2 and FIG. 3. In this embodiment, the elastic assembly is composed of springs 11, 12 disposed approximately concentrically encircling hexagonal drive rod 5. The free height $H_0$ of the first spring 11 is larger than the free height $H_0'$ of the second spring 12, while the elastic modulus $E_2$ of the second spring 12 is larger than the elastic modulus $E_1$ of the first spring 11. At least one end of spring 11 and spring 12 engages on the side of ratchet 28 to fit ratchet 28 tightly with ratchet 29 by the elastic force in the axial direction, so that the clockwise input torque on the ratchets 28, 29 need to overcome the elastic force of the spring to enable ratchets 28, 29 to slide on each other. And the elastic force of springs 11, 12 is proportional to the amount of its compression, thus, by setting the compression of springs 11, 12, the maximum output torque on the ratchets 28 and 29 in the clockwise direction can be adjusted and controlled.

Figure 7:
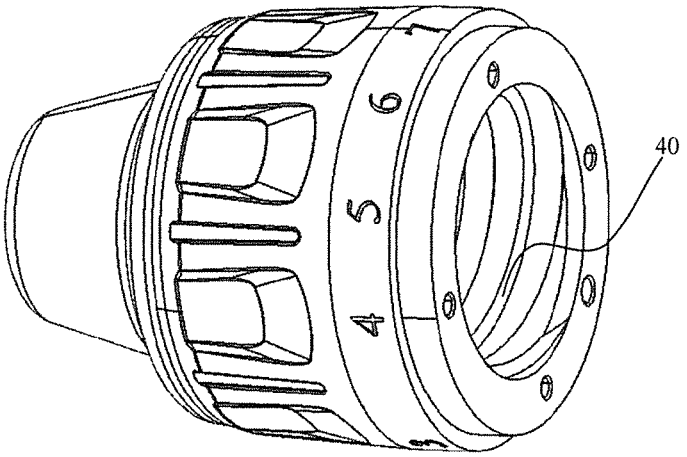
FIG. 7 is a perspective view of an outer casing of an adjustable torque screwdriver of a preferred embodiment of the present invention.
Figure 8A:
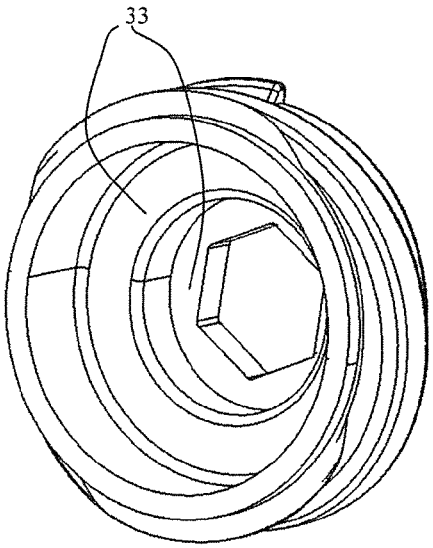
FIG. 8(*a*) and FIG. 8(*b*) are perspective views of an interior ring of an adjustable torque screwdriver of a preferred embodiment of the present invention.
Figure 8B:
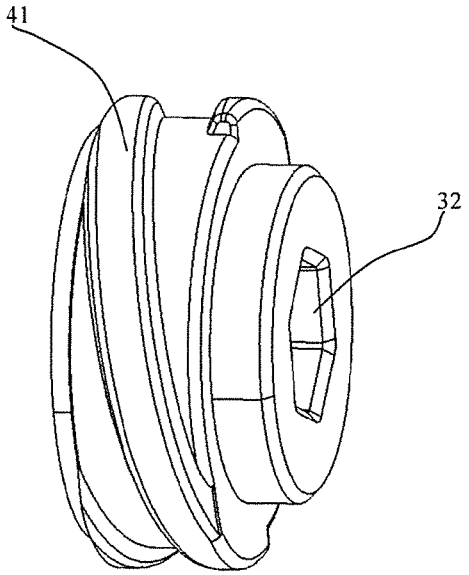

The torque control assembly also includes an adjusting assembly which is mainly used for adjustment of the compression of springs 11, 12, as shown in FIG. 2, and a flange 8 arranged between handle 2 and hexagonal sleeve 4, which is connected to outer casing 13 by multiple small screws 9 disposed on the convex edge thereof. In this embodiment, outer casing 13 is also the outer casing of the screwdriver 100 head, an opening end of which rotatablly fits the periphery 21 of handle 2, as shown in FIG. 7, and internal thread 40 is arranged on the inside of outer casing 13, ratchets 28, 29 and springs 11, 12 all disposed in outer casing 13. The torque control assembly also include, as is shown in FIG. 8, an interior ring 10 matching inside the outer casing 13, the external side of which is arranged with external thread 41 matching with internal thread 40 of outer casing 13, and a third hexagonal through hole 32 and concave stage 33 are arranged inside for the axial passing through of hexagonal drive rod 5, as seen in FIGS. 8(*a*) and 8(*b*). One end of each springs 11,12 is engaged on the side of the first ratchet 28 and the other ends are engaged on the concave stage 33 inside interior ring 10. When the user revolves outer casing 13 about the axial of the screwdriver 100 relative to handle 2, interior ring 10 is not enabled to revolve about the axial of the screwdriver 100, as the hexagonal through hole 32 thereof is constrained by hexagonal drive rod 5 in the circumferential direction, so that interior ring 10 is only enabled to translate along hexagonal drive rod 5 under the effect of the thread pair, which deforms springs 11, 12 to adjust the axial force thereof exerted on ratchet 28, and as the free height of the first spring 11 $H_0$ is larger than the free height $H_0'$ of the second spring 12, in the starting stage the first spring 11 is firstly compressed and deforms, ratchet 28 then only receives exerted force from spring 11, and when spring 11 deforms to a certain degree, the translation of interior ring consequently causes the second spring 12 to deform, ratchet 28 then receives both elastic forces from springs 11, 12, and as the elastic modulus $E_2$ of the second spring 12 is larger than the elastic modulus $E_1$ of the first spring 11, thus the accelerating rate of elastic force received by ratchet 28 increases. The arrangement of the double-stage springs as adopted by the embodiment, on one hand, enables a broader range of torque adjustment, especially in a low torque region, and on the other hand, prolongs the service life of the second spring 12 which has a large elastic modulus $E_2$. It should be understood by technicians of the field that the spring group can further include multiple springs having different free heights and elastic modulus so as to form a multi-stage arrangement.

Further, as shown in the figure, handle 2 is arranged with a grading spring 6 and bead 7, and accordingly flange 8 is arranged with a plurality of round holes 36. When the outer casing 13 rotates, the flange 8 rotates along with it, so that the bead in turn falls into the round holes on the flange 36 by the elastic biasing force of the grading spring. In addition, as shown in the figure, outer casing 13 is arranged with grading marks corresponding to the locations of round holes 36 with indication arrow arranged on handle 2, so that users can revolve outer casing 13 to set the output torque of the screwdriver 100 to a required grade.

Torque output assembly includes a torque output shaft 18, having a hexagonal contour at one end of it, and can be inserted into and fit the second hexagon hole 35 of the second ratchet 29. Further, as shown in the figure, a blind hole is disposed on the surface of the shaft end. Accordingly, a convex boss extends from the end of hexagonal drive rod 5 inserted in the first hexagon hole 34 of the first ratchet 28. During assembly, the convex boss is connected into the blind hole. The other end of the torque output shaft, through sleeve 17, flat gasket 16, and shaft retaining ring 15, extends from the opening 37 of outer casing 13, and mounting holes are arranged in the other end surface to mount all kinds of screwdriver bits.

The foregoing disclosure is only a specific description of a torque transmission method, the object of which is to realize torque input in the adjustable torque screwdriver 100 of the invention. It should be understood by the technicians in the field that, other torque transmission means of the prior art are adaptable to, but are not intended to be restricted by, the present invention.

The foregoing description details the preferred embodiments of the invention. It should be understood that with the general technique of this field, no inventive work is necessary as to make multiple amendments and changes according to the conception of this invention. Therefore, all the technical schemes gained from logical analysis, deductions or limited experimentation based on the conception of the present invention by technicians in this field, should be considered within the protection range asserted in the Claims.

The invention claimed is:

1. An adjustable torque screwdriver, comprising a torque input assembly and a torque output assembly, characterized in that the adjustable torque screwdriver also includes a ratchet pair, the ratchet pair consists of a first ratchet and a second ratchet having circular teeth, respectively, said torque input assembly transmits torque to the first ratchet, the second ratchet transmits torque to the torque output assembly, the circular teeth are arranged to enable the ratchet pair to slip either clockwise or counterclockwise, but not to slip in the respective opposite direction, and the adjustable torque screwdriver also includes an adjusting assembly and an elastic assembly, the elastic assembly exerts pressure to the ratchet pair, and the adjusting assembly loads and unloads the elastic assembly, thus adjusting the exerted pressure and the in-between fitting tightness of the ratchet pair, thereby adjusting the torque for the ratchet pair to slip, wherein the elastic assembly is a spring group which includes a plurality of springs each approximately concentrically disposed about an axis of the screwdriver, each of the springs having respectively a specific free height and an elastic modulus;

wherein the adjusting assembly includes an outer casing with an internal thread and an interior ring with an external thread, the interior ring matching with the outer casing through the threads, and not allowed to rotate about the axis of the screwdriver, when the outer casing revolves about the axis of the screwdriver relative to the interior ring, the interior ring translates relative to the elastic assembly under the effect of the threads, thus loading or unloading the elastic assembly.

2. The adjustable torque screwdriver as claimed in claim 1, wherein the spring group includes a first spring and a second spring, the free height of the first spring is larger than that of the second spring, and the elastic modulus of the second spring is larger than that of the first spring.

3. The adjustable torque screwdriver as claimed in claim 1, wherein the adjusting assembly also includes a flange rotating together with the outer casing, a plurality of round holes arranged on the flange, and a bead mating with the round holes and a grading spring biasing the bead.

4. The adjustable torque screwdriver as claimed in claim 3, wherein the outer casing is disposed in the head part of the adjustable torque screwdriver, and the ratchet pair and elastic assembly are disposed in the outer casing.

5. The adjustable torque screwdriver as claimed in claim 4, wherein the elastic assembly is disposed on the side of the first ratchet.

6. The adjustable torque screwdriver as claimed in claim 5, wherein the outer casing is rotatablly connected to the handle about the axis of the adjustable torque screwdriver.

7. The adjustable torque screwdriver as claimed in claim 6, wherein the handle has a cavity.

8. The adjustable torque screwdriver as claimed in claim 7, wherein the handle has a rear cover.

9. The adjustable torque screwdriver as claimed in claim 6, wherein grading marks are disposed on the outer casing and an indication arrow is arranged on the handle.

10. The adjustable torque screwdriver as claimed in claim 1, wherein the outer casing is disposed in the head part of the adjustable torque screwdriver, and the ratchet pair and elastic assembly are disposed in the outer casing.

11. The adjustable torque screwdriver as claimed in claim 10, wherein the elastic assembly is disposed on the side of the first ratchet.

12. The adjustable torque screwdriver as claimed in claim 11, wherein the outer casing is rotatablly connected to the handle about the axis of the adjustable torque screwdriver.

13. The adjustable torque screwdriver as claimed in claim 12, wherein the handle has a cavity.

14. The adjustable torque screwdriver as claimed in claim 13, wherein the handle has a rear cover.

15. The adjustable torque screwdriver as claimed in claim 12, wherein grading marks are disposed on the outer casing and an indication arrow is arranged on the handle.

* * * * *